United States Patent [19]

Weinberg et al.

[11] Patent Number: 4,773,985

[45] Date of Patent: Sep. 27, 1988

[54] METHOD OF OPTIMIZING MESOPHASE FORMATION IN GRAPHITE AND COKE PRECURSORS

[75] Inventors: Victoria L. Weinberg, North Hollywood; Mohammad-Ali Sadeghi, Los Angeles; Teh F. Yen, Altadena, all of Calif.

[73] Assignee: University of Southern California, Los Angeles, Calif.

[21] Appl. No.: 723,121

[22] Filed: Apr. 12, 1985

[51] Int. Cl.[4] ..... C10C 1/00; C10C 3/00

[52] U.S. Cl. ..... 208/39; 208/22; 208/40; 423/445; 423/447.2; 423/447.4; 423/449; 423/448

[58] Field of Search ..... 208/39, 22, 40; 423/445, 447.2, 447.4, 448, 449

[56] References Cited

U.S. PATENT DOCUMENTS

| | | | |
|---|---|---|---|
| 3,991,170 | 11/1976 | Singer | 208/39 |
| 4,303,631 | 12/1981 | Lewis et al. | 208/39 |
| 4,414,096 | 11/1983 | Dickakian | 208/39 |
| 4,427,531 | 1/1984 | Dickakian | 208/39 |
| 4,449,586 | 5/1986 | Urban et al. | 208/459 |
| 4,454,020 | 6/1984 | Izumi et al. | 208/39 |
| 4,457,828 | 7/1984 | Lewis | 208/39 |
| 4,460,454 | 7/1984 | Iijima et al. | 208/40 |
| 4,464,248 | 8/1984 | Dickakian | 208/39 |
| 4,474,617 | 10/1984 | Uemura et al. | 208/40 |
| 4,488,957 | 12/1984 | Noguchi et al. | 208/39 |
| 4,504,455 | 3/1985 | Otani et al. | 208/39 |
| 4,504,943 | 3/1985 | Dickakian | 208/39 |
| 4,518,482 | 5/1985 | Dickakian | 208/22 |
| 4,522,701 | 6/1985 | Dickakian | 208/22 |
| 4,528,087 | 7/1985 | Shibatani et al. | 208/22 |
| 4,581,123 | 4/1986 | Dickakian | 208/39 |
| 4,596,652 | 6/1986 | Shibatani et al. | 208/22 |
| 4,600,496 | 7/1986 | Cheng et al. | 208/22 |
| 4,620,919 | 11/1986 | Uemura et al. | 208/22 |

*Primary Examiner*—Carl F. Dees
*Assistant Examiner*—Helane Myers
*Attorney, Agent, or Firm*—Nilsson, Robbins, Dalgarn, Berliner, Carson & Wurst

[57] ABSTRACT

Mesophase formation is optimized in graphite and coke precursors by a process which includes determining the values of critical chemical parameters for proposed precursors, modifying the precursors by adjusting such critical chemical parameters as oxygen content, aromaticity and functionality to within certain predetermined optimal limits and treating the resulting modified precursors to form mesophase. Oxygen content can be adjusted by oxidation or reduction of the precursor. Aromaticity can be adjusted by suitable heat treatment. Functionality can be adjusted by derivatization.

3 Claims, No Drawings

METHOD OF OPTIMIZING MESOPHASE FORMATION IN GRAPHITE AND COKE PRECURSORS

This invention was made with Government support under Grant No. CPE-83-19288 from the National Science Foundation. The Government has certain rights in this invention.

BACKGROUND OF THE INVENTION

This invention relates to the carbonization of natural carbonaceous materials. In one of its more particular aspects this invention relates to a process for optimizing carbonization reactions such as the production of graphite or coke.

It is known that certain graphite or coke precursors are more readily carbonized to produce better products or to produce such products in better yields than others. It is also known that the microstructure and properties of carbonized materials are determined by the characteristics of an ordered fluid, termed the "carbonaceous mesophase", which forms during pyrolysis, usually between the temperatures of 370° C. and 500° C. It is the order developed in this mesophase that determines the properties of the final product obtained, for example, after heating to graphitizing temperatures of 2800° C. The mesophase in carbonaceous materials which graphitize displays an optically anisotropic microstructure, from which the properties of the carbonized product can be predicted. An isotropic microstructure, on the other hand, indicates a non-graphitizing carbon. The characteristics of the final product thus are controlled by the mesophase formed below 500° C. These characteristics can be determined in a qualitative way by microscopic analysis using a cross-polarizing microscope at various stages of the pyrolysis.

Although the need for optimizing the chemical composition of precursors for graphite and coke formation has long been appreciated, precisely what chemical compositions might be considered optimum and how to provide such optimal chemical composition from readily available candidate precursor materials have until now been unattained goals.

It is accordingly an object of the present invention to provide a means for selecting precursors for graphite and coke formation.

Another object of this invention is to provide a means for optimizing mesophase formation during the carbonization of precursor materials.

Another object of this invention is to provide a means for furnishing precursors which will form mesophase upon suitable treatment.

Other objects and the advantages of this invention will become apparent in the course of the following detailed description.

SUMMARY OF THE INVENTION

In general, the present invention provides a process for optimizing mesophase formation in graphite and coke precursors. This process includes the steps of determining a chemical parameter of a graphite or coke precursor critical to mesophase formation, adjusting the chemical parameter to within a predetermined optimal range by physical or chemical treatment of the precursor, and inducing mesophase formation in the resulting parameter-adjusted precursor.

A particular advantage of the present invention is that any proposed precursor material can be analyzed to determine whether it meets the criteria for a good precursor. If not, it can be modified using various physical and chemical methods to provide a precursor material which will, upon pyrolysis, display a mesophase morphology indicative of graphite or coke having the properties desired.

DESCRIPTION OF THE PREFERRED EMBODIMENTS

Previously, petroleum and coal tar pitches were used as starting materials for the production of graphite. However, the isolation of such carbonaceous fractions requires extensive processing. According to the process of the present invention many readily obtainable carbonaceous materials can be physically or chemically treated in order to provide a precursor which will result in the production of a coke or graphite having desirable thermal and tensile properties. Such materials include coal oils, shale oils, asphaltenes, preasphaltenes and various oil and resin fractions of coal oils and petroleum frequently considered waste materials. The invention will be illustrated with respect to the use of particular graphite and coke precursors. However, it should be understood that any of the other carbonaceous materials mentioned above or similar materials can be used in the present invention.

The formation of a mesophase having the desired morphology has been found to be predictive of the properties of the graphite or coke produced by pyrolyzing a particular precursor. Accordingly, optimizing mesophase formation is tantamount to optimizing graphite or coke production. The emphasis in the present invention, therefore, will be upon mesophase formation and its optimization by adjusting certain critical chemical parameters of the precursor used for production of graphite or coke.

Among the critical chemical parameters which affect mesophase formation are oxygen content, aromaticity and functionality. These parameters control the morphology of the mesophase and, within certain predetermined critical ranges, the production of carbonized products having desirable physical and chemical properties.

Oxygen content above a certain predetermined level suppresses mesophase formation. Undesired cross-linked ether groups are introduced resulting in intermediates which are not flat and cannot be incorporated into the ordered structure of the mesophase. Rather, an increase in viscosity results with a decrease in molecular mobility so that mesophase growth becomes virtually impossible. With very high oxygen contents the melting point of the precursor is also increased until at about 8.5 percent to 9 percent by weight of oxygen the precursor no longer melts but goes directly to a disordered char. The practical limit of oxygen concentration has been found to be in the range of about 2–6 percent by weight. Within this range the precursor melts at a reasonable temperature to form a liquid which, upon continued heating, in converted into nucleating mesophase spherules. As heating continues further, the mesophase hardens into coke or graphite depending upon the particular precursor used. By decreasing the oxygen content of the precursor, the hardening temperature rises, coarse and finely formed microstructures result, and finally, a desired needle coke morphology is observed.

Oxygen content of the precursor can be readily determined by elemental analysis.

Adjusting the oxygen content to within desired limits can be accomplished by means of oxidation or reduction. Oxidation is seldom required, since most precursors have an adequate oxygen content. However, if necessary, catalytic or chemical oxidation may be used to adjust the oxygen content to the desired level. Lowering of the oxygen content may be accomplished in various ways, which will be discussed with respect to varying the functionality of the precursor.

Aromaticity is another parameter which can be measured and adjusted in accordance with the process of the present invention. Large planar molecules are necessary for mesophase formation. Mesophase is formed from a precursor which is highly aromatic and has a large aromatic core with short aliphatic side chains. Less aromatic precursors, which have small aromatic cores and longer aliphatic side chains, tend to suppress mesophase formation by dealkylation during pyrolysis. Such dealkylation reactions disrupt the order of the mesophase and prevent condensation of large planar molecules. At low aromaticity, around 0.65, mesophase growth is suppressed by dealkylation reactions, resulting in a fine isotropic microstructure. Between about 0.7 and 0.9, mesophase can nucleate, grow and coalesce to the desired morphology. At aromaticities of about 0.95 or higher, such high temperatures are required for melting that the molecules cannot stay fluid long enough to form mesophase and undesired glassy microstructures result. In general, the aromaticity must be between about 0.7 and 0.9 to assure optimal mesophase formation.

Aromaticity can be measured in a variety of different ways. Brown-Ladner analysis, for example, requires the proton nuclear magnetic resonance spectrum (NMR), the average molecular weight, and the elemental analysis of the material. J. K. Brown et al., *Fuel,* 39: 87 (1960); I. Schwager et al., *Advances in Chemistry,* American Chemical Society (1977).

According to a modified Brown-Ladner equation, the aromaticity $f_a$ is given by the equation:

$$f_a = \frac{\frac{C}{H} - \left[\frac{H}{x}\alpha + \frac{H_o}{y}\right]}{\frac{C}{H}}$$

where

C=mole % carbon.

H=mole % hydrogen.

$H_\alpha$=mole fraction hydrogen alpha to an aromatic ring.

$H_o$=mole fraction aliphatic hydrogen not alpha to an aromatic ring.

x=average ratio of hydrogen to carbon on carbons alpha to an aromatic ring.

y=average ratio of hydrogen to carbon on an aliphatic carbon not alpha to an aromatic ring.

Determination of C and H is made by means of elemental analysis and molecular weight determinations. Molecular weight can be readily determined by use of a vapor pressure osmometer or by other well known methods for determining molecular weight. The quantities $H_\alpha$ and $H_o$ are determined by assigning the areas of absorption in the proton nuclear magnetic resonance spectrum centered at $\delta$=7.3, 2.4, and 1.2 ppm to aromatic ring protons, aliphatic protons adjacent to aromatic rings, and aliphatic protons not adjacent to aromatic rings, respectively. The latter two absorptions correspond to $H_\alpha$ and $H_o$. The quantities x and y are calculated values.

Nuclear magnetic resonance spectra can also be used to obtain the aromaticity of the precursor, S. A. Qian et al., *Fuel,* 63: 268 (1984).

In order to adjust the aromaticity of the precursor to the desired level, a number of chemical and physical treatments can be used. For example, a Birch reduction can be used to reduce the aromaticity by converting some of the aromatic rings to cyclic dienes, I. Mochida et al., *Fuel,* 55: 70 (1976). Other chemical treatments may be used as well. Heating of the precursor prior to pyrolysis has been found to be effective to increase the aromaticity of the precursor. For example, refluxing the precursor at temperatures below about 300° C. for one to several days has been found effective to increase the aromaticity of the precursor and to improve mesophase formation.

Vacuum treatment is another means to change the aromaticity of the precursor material.

In addition to the Birch reduction, it is possible to reduce the aromaticity by hydrogenation over Lewis acid catalysts under mild conditions. S. S. Salim et al., *Fuel,* 63: 469 (1984). Any other known technique for increasing the aromaticity of complex aromatic molecules can also be used, if desired.

The functionality of the precursor molecule affects the formation and growth of mesophase in a number of respects. Hydroxyl groups can affect the hydrogen bonding of various parts of the molecule and may prevent the formation of the desired planar structure if the hydroxyl content is too high. Carbonyl content can prevent the desired aromaticity level from being reached and can adversely influence the formation of mesophase. Amino groups can be disruptive of mesophase formation as can the presence of sulfhydryl groups which may interact with other parts of the molecule and prevent the desired geometry from being achieved. In general, it is desired to keep the oxygen, nitrogen and sulfur functionality of the molecule low in order to avoid various interferences with mesophase formation.

In addition to the information concerning functionality obtainable from proton nuclear magnetic resonance spectra and 13C nuclear magnetic resonance spectra, it has been found desirable to utilize infrared analysis to obtain information about the functionality of the precursor molecule. One particularly desirable method for obtaining more definitive information with respect to functionality is the use of Fourier Transform Infrared (FTIR) methods from which semiquantitative data on oxygen, nitrogen and sulfur functional groups can be obtained. Various techniques are known for this purpose. Weinberg describes a number of such techniques in V. L. Weinberg, Ph.D. Dissertation, USC (1981).

In order to adjust the functionality of a proposed precursor, various known techiniques can be used. For example, O-alkylation as described by Liotta et al. consists of suspending the precursor in tetrahydrofuran under nitrogen and slowly adding aqueous tetrabutylammonium hydroxide to remove all acidic protons before adding methyl iodide as the alkylating agent. R. Liotta et al., *J. Org. Chem.,* 46: 277 (1981). Another useful derivatization which can be used is the formation of trimethyl silyl ethers, which are synthesized by refluxing the precursor with excess 1,1,1,3,3,3-hexamethyldisilazane (HMDS) and catalytic amounts of trimethylchlorosilazane and pyridine in tetrahydrofuran. S. Friedman et al., *Fuel,* 40: 33 (1961). Another method involves the formation of alkyl esters using acetic anhydride in pyridine as the acetylating agent. P. C. Painter et al., *Appl. Spectrosc,* 35: 475 (1981). Decarboxylation is another technique which can be used under the appropriate circumstances. One method of decarboxylation is the use of a basic copper carbonate catalyst is quinoline. D. W. Van Krevelen, "Coal", p. 163, Elsevier Publishing Company, N.Y. (1961). Other methods which can be used include demineralization and carbonyl derivatization. Demineralization is described in I. Mochida et al., *Fuel,* 63: 847 (1984). Derivatization of carbonyl groups can be readily conducted using any of a wide variety of known carbonyl reactions.

With respect to adjusting the functionality of the precursor, the procedure requires that the precursor be analyzed to determine which, if any, functional groups which may interfere with mesophase formation are present in the precursor. Once that determination has been made, derivatization procedure is useful to effectuate adjustment of the functionality in the desired direction.

The invention will be better understood by reference to the following examples, which are intended to be merely illustrative of the invention and not limiting in any way.

EXAMPLE 1

Vacuum distillate bottoms of Green River shale oil (200 g.) were heat treated by refluxing under nitrogen gas at a temperature of 285 degrees C. for 5 hours, 25 hours and 74 hours. The heat treated samples (0.5 g.) were pyrolyzed by placing in aluminum pyrolysis tube cells with 0.5 mm. pinhole openings for vapor escape. The tubes were placed in stainless steel cells, then put in a temperature programmed furnace and purged with nitrogen gas controlled at 15 liters per hour. The temperature was programmed at 13 degrees C. per hour to 360 degrees C. and 5 degrees C. per hour to the desired final temperature of 465 degrees C. The residues of the pyrolyzed sample were examined under polarized light using a Leitz SM-Lux-Pol cross-polarizing microscope. These residues were first cast in epoxy resin and polished until the surfaces were optically smooth. Micrographs were obtained and compared with samples of pyrolyzed non-heat treated vacuum distillate bottoms. Coarse mosaic microstructures indicating optimal mesophase formation were observed in the case of the 5 hour heat treated sample. The pyrolyzed original bottoms resulted in isotropic microstructures indicating poor mesophase formation as did the samples treated for 25 hours and 74 hours.

EXAMPLE 2

A Catalytic, Inc. coal liquid asphaltene having an oxygen content of 4.59 percent by weight was air oxidized at 200 degrees for 24 hours. The resulting oxygen content was 6.66 percent by weight. The asphaltene and oxidized asphaltene were pyrolyzed and microscopically examined according to the procedure of Example 1. The non-oxidized asphaltene showed a coarse mosaic microstructure while the oxidized asphaltene showed isotropic microstructure.

EXAMPLE 3

A 5 gram sample of FMC COED liquid asphaltene showing a high phenolic content as determined by the infrared and proton nuclear magnetic resonance spectra was dissolved in 200 ml. anhydrous THF while stirring in a 3-necked flask. $LiAlH_4$ (2.5 g). was added slowly to the solution. The solution was then refluxed with nitrogen with stirring for 20 hours. The resulting solution was separated using 25 ml. distilled $H_2O$ and 25 ml 15 percent NaOH in an ice bath. Then 75 ml. distilled $H_2O$ was added and the solution was filtered and washed with ether until no color was present in the residue. The solution was then rotary evaporated to remove solvents. The resulting reaction product was subjected to infrared and NMR analysis and found to have low phenolic absorption. Pyrolysis and microscopic analysis indicated a clear improvement in mesophase formation over the untreated asphaltene.

What is claimed is:

1. A process for optimizing mesophase formation in graphite and coke precursors which comprises:

determining the oxygen content and aromaticity of a precursor selected from the group consisting of coal oils, shale oils, asphaltenes and preasphaltenes, where the aromaticity, $f_a$, is defined by the equation:

$$f_a = \frac{\frac{C}{H} - \left[\frac{H}{x}\alpha + \frac{H_o}{y}\right]}{\frac{C}{H}}$$

where

C=mole percent carbon,

H=mole percent hydrogen, $H_\alpha$=mole fraction hydrogen alpha to an aromatic ring, $H_o$=mole fraction aliphatic hydrogen not alpha to an aromatic ring, x=average ratio of hydrogen to carbon on carbons alpha to an aromatic ring, and y=average ratio of hydrogen to carbon on aliphatic carbons not alpha to an aromatic ring;

adjusting the oxygen content of said precursor to one within the range of about 2–6 percent by weight by chemical or catalytic oxidation or reduction and the aromaticity to one within the range of about 0.7–0.9 by preheating or vacuum treating said precursor, by chemical reduction of said precursor or by hydrogenation of said precursor over a Lewis acid catalyst; and inducing mesophase formation by melting and resulting oxygen content-adjusted and aromaticity-adjusted precursor and continuing heating until the resulting liquid is converted into nucleating mesophase spherules.

2. A process for optimizing mesophase formation in graphite and coke precursors which contain hydroxyl, carboxyl, carbonyl or mineral functional groups which interfere with mesophase formation which comprises:

determining the oxygen content, aromaticity and content of interfering functional groups in a precursor selected from the group consisting of coal oils, shale oils, asphaltenes and preasphaltenes;

adjusting the oxygen content of said precursor to one within the range of about 2–6 percent by weight by chemical or catalytic oxidation or reduction;

adjusting the aromaticity as defined in claim 1 to one within the range of about 0.7–0.9 by preheating or vacuum treating said precursor, by chemical reduction of said precursor or by hydrogenization of said precursor over a Lewis acid catalyst;

reacting said precursor with an O-alkylating agent or an esterifying agent to reduce the hydroxyl content of said precursor;

reacting said precursor with a decarboxylating agent to reduce the carboxyl content of said precursor;

reacting said precursor with a carbonyl derivatizing agent to reduce the carbonyl content of said precursor; and reacting said precursor with a demineralizing agent to reduce the mineral content of said precursor;

to provide a precursor having a reduced content of interfering functional groups; and inducing mesophase formation by melting and resulting precursor having a reduced content of interfering functional groups and continuing heating until the resulting liquid is converted into nucleating mesophase spherules.

3. A process for optimizing mesophase formation in graphite and coke precursors which contain hydroxyl, carboxyl, carbonyl or mineral functional groups which interfere with mesophase formation which comprises:

determining the content of interfering functional groups in a precursor selected from the group consisting of coal oils, shale oils, asphaltenes and preasphaltenes;

reacting said precursor with an O-alkylating agent or an esterifying agent to reduce the hydroxyl content of said precursor;

reacting said precursor with a decarboxylating agent to reduce the carboxyl content of said precursor;

reacting said precursor with a carbonyl derivatizing agent to reduce the carbonyl content of said precursor; and reacting said precursor with a demineralizing agent to reduce the mineral content of said precursor;

to provide a precursor having a reduced content of interfering functional groups; and inducing mesophase formation by melting the resulting precursor having a reduced content of interfering functional groups and continuing heating until the resulting liquid is converted into nucleating mesophase spherules.

* * * * *

UNITED STATES PATENT AND TRADEMARK OFFICE

CERTIFICATE OF CORRECTION

PATENT NO. : 4,773,985

DATED : September 27, 1988

INVENTOR(S) : Weinberg et al

It is certified that error appears in the above-identified patent and that said Letters Patent is hereby corrected as shown below:

Under the heading "Inventors:", delete "Victoria L. Weinberg, North Hollywood; Mohammad-All Sadeghi, Los Angeles; Teh F. Yen, Altadena, all of Calif."

and insert therefor --Mohammad-All Sadeghi, Los Angeles; Victoria L. Weinberg, North Hollywood; Teh F. Yen, Altadena, all of Calif.--

Signed and Sealed this

Eleventh Day of April, 1989

*Attest:*

*Attesting Officer*

DONALD J. QUIGG

*Commissioner of Patents and Trademarks*